US006663373B2

(12) United States Patent
Yoshida

(10) Patent No.: US 6,663,373 B2
(45) Date of Patent: Dec. 16, 2003

(54) APPARATUS FOR MAKING NONWOVEN FABRIC

(75) Inventor: Masaki Yoshida, Kagawa-ken (JP)

(73) Assignee: Uni-Charm Corporation, Kawanoe (JP)

( * ) Notice: Subject to any disclaimer, the term of this patent is extended or adjusted under 35 U.S.C. 154(b) by 132 days.

(21) Appl. No.: 09/885,161

(22) Filed: Jun. 21, 2001

(65) Prior Publication Data

US 2002/0020047 A1 Feb. 21, 2002

(30) Foreign Application Priority Data

Jul. 5, 2000 (JP) ..... 204399

(51) Int. Cl.[7] ..... D01D 5/092
(52) U.S. Cl. ..... 425/72.2; 425/382.2
(58) Field of Search ..... 425/66, 72.1, 83.1, 425/382.2, 387.1, 464, 72.2

(56) References Cited

U.S. PATENT DOCUMENTS

| | | | | | |
|---|---|---|---|---|---|
| 2,732,885 | A | * | 1/1956 | Van Der Hoven | 65/464 |
| 4,626,184 | A | * | 12/1986 | Hammond | 425/83.1 |
| 4,627,811 | A | | 12/1986 | Greiser et al. | 425/72.2 |
| 4,818,466 | A | | 4/1989 | Mente et al. | 264/555 |
| 4,820,459 | A | * | 4/1989 | Reifenhauser | 425/66 |
| 5,098,636 | A | * | 3/1992 | Balk | 264/555 |
| 5,211,903 | A | * | 5/1993 | Reifenhauser | 264/555 |
| 5,292,239 | A | | 3/1994 | Zeldin et al. | 425/66 |
| 5,460,500 | A | | 10/1995 | Geus et al. | 425/66 |
| 5,648,041 | A | * | 7/1997 | Rodgers et al. | 264/555 |
| 5,766,646 | A | | 6/1998 | Geus et al. | 425/72.2 |
| 5,820,888 | A | * | 10/1998 | Geus et al. | 425/66 |
| 6,468,063 | B1 | * | 10/2002 | Kobayashi et al. | 425/66 |

FOREIGN PATENT DOCUMENTS

DE 2 163 795 7/1973

OTHER PUBLICATIONS

Patent Abstracts of Japan No. 08003852, Asano Masaji, Jan. 9, 1996.

* cited by examiner

*Primary Examiner*—Robert Davis
*Assistant Examiner*—Joseph S Del Sole
(74) *Attorney, Agent, or Firm*—Lowe Hauptman Gilman & Berner LLP

(57) ABSTRACT

An apparatus for making a nonwoven fabric including, between spinning nozzles and a top surface of an air-permeable endless belt running in one direction, air blow means spaced apart from the nozzles, a duct directly connected to the air blow means and a hood directly connected to the duct so as to cover the vicinity of the top surface of the endless belt so that the interior of the hood may be subjected to a suction effect exerted through the endless belt from below the endless belt.

10 Claims, 3 Drawing Sheets

APPARATUS FOR MAKING NONWOVEN FABRIC

BACKGROUND OF THE INVENTION

This invention relates to an apparatus for making a nonwoven fabric from continuous fibers.

There have already been proposed a process as well as an apparatus adapted to accumulate continuous fibers discharged from spinning nozzles of an extruder onto a top surface of an endless belt running in one direction and thereby to make a nonwoven fabric. The endless belt in the known apparatus is air-permeable and there is provided below this endless belt with a suction zone. It is well known in the known apparatus to provide an air gun or suckers serving to blow pressurized air against the continuous fibers, to provide a relatively narrow duct below the air gun or the suckers and to provide a hood below the duct so that the endless belt may be partially covered with the hood.

Provision of the duct and the hood in accordance with the prior art enables a stretching ratio for the fibers to be improved and thereby a desired nonwoven fabric to be made from the continuous fibers having a relatively small denier number. However, the fibers discharged from the spinning nozzles must be previously thinned in order to obtain the fibers having a fineness smaller than 1 d and this requirement deteriorates a production efficiency of a nonwoven fabric per unit time.

SUMMARY OF THE INVENTION

It is an object of this invention to improve the known apparatus so that the nonwoven fabric may be efficiently made from the continuous fibers of a fineness less than 1 d.

According to this invention, there is provided an apparatus for making a nonwoven fabric adapted to accumulate continuous fibers discharged from a plurality of spinning nozzles onto a top surface of an air-permeable endless belt running in one direction under a suction effect exerted from below the endless belt, wherein: between the nozzles and the endless belt, the apparatus comprises means adapted to blow pressurized air against the continuous fibers, a duct having a relatively small dimension as viewed in running direction of the endless belt and directly connected to the means so as to extend downward and a hood having a relatively large dimension as viewed in the running direction and directly connected to the duct so as to cover a vicinity of the endless belt's top surface so that an interior of the hood may be subjected to the suction effect exerted through the endless belt from below the endless belt.

DETAILED DESCRIPTION OF THE PREFERRED EMBODIMENT

Details of an apparatus for making a nonwoven fabric according to this invention will be more fully understood from the description given hereunder with reference to the accompanying drawings.

Figure 1:
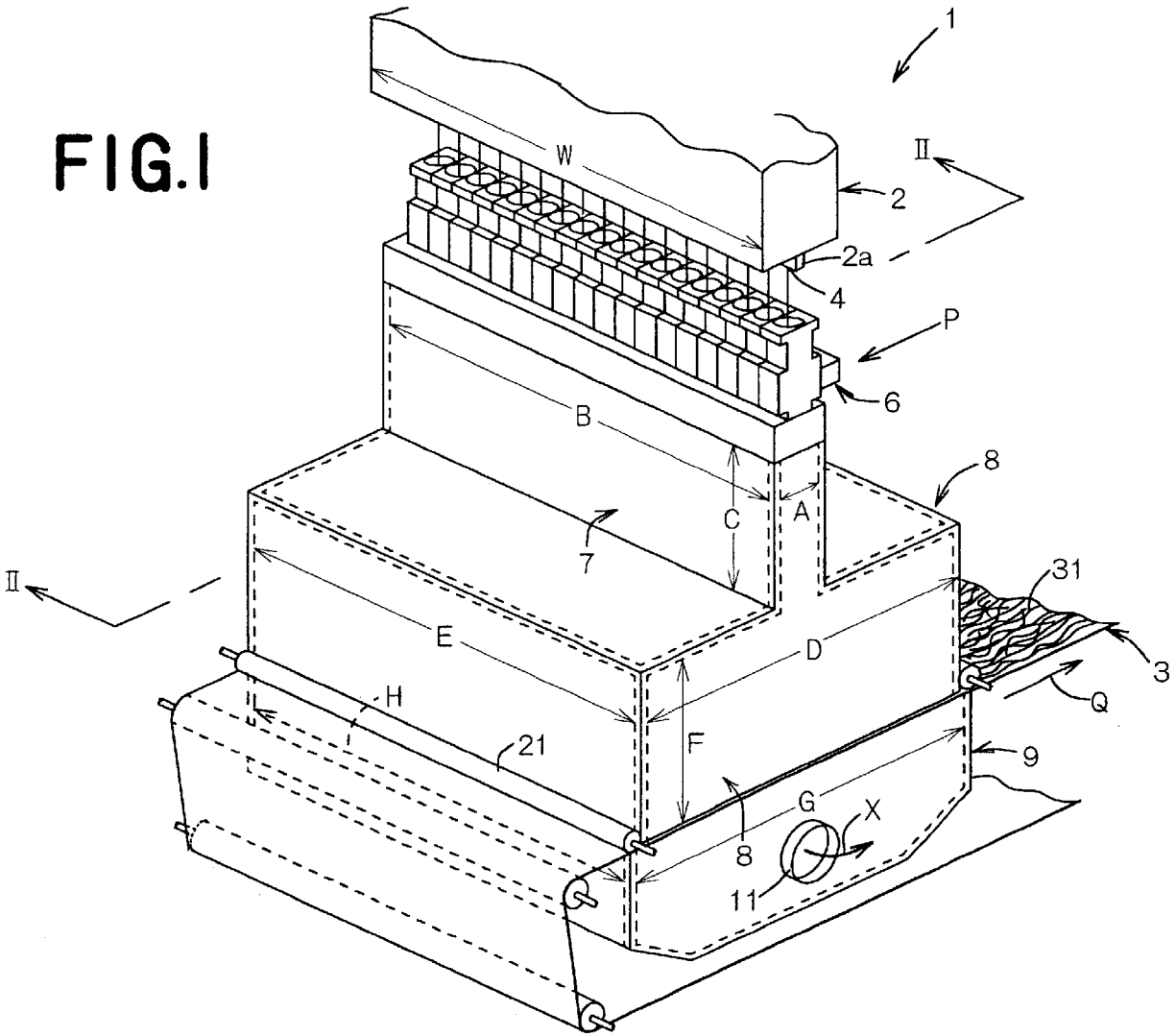
FIG. 1 is a fragmentary perspective view showing an apparatus for making a nonwoven fabric.
Figure 2:
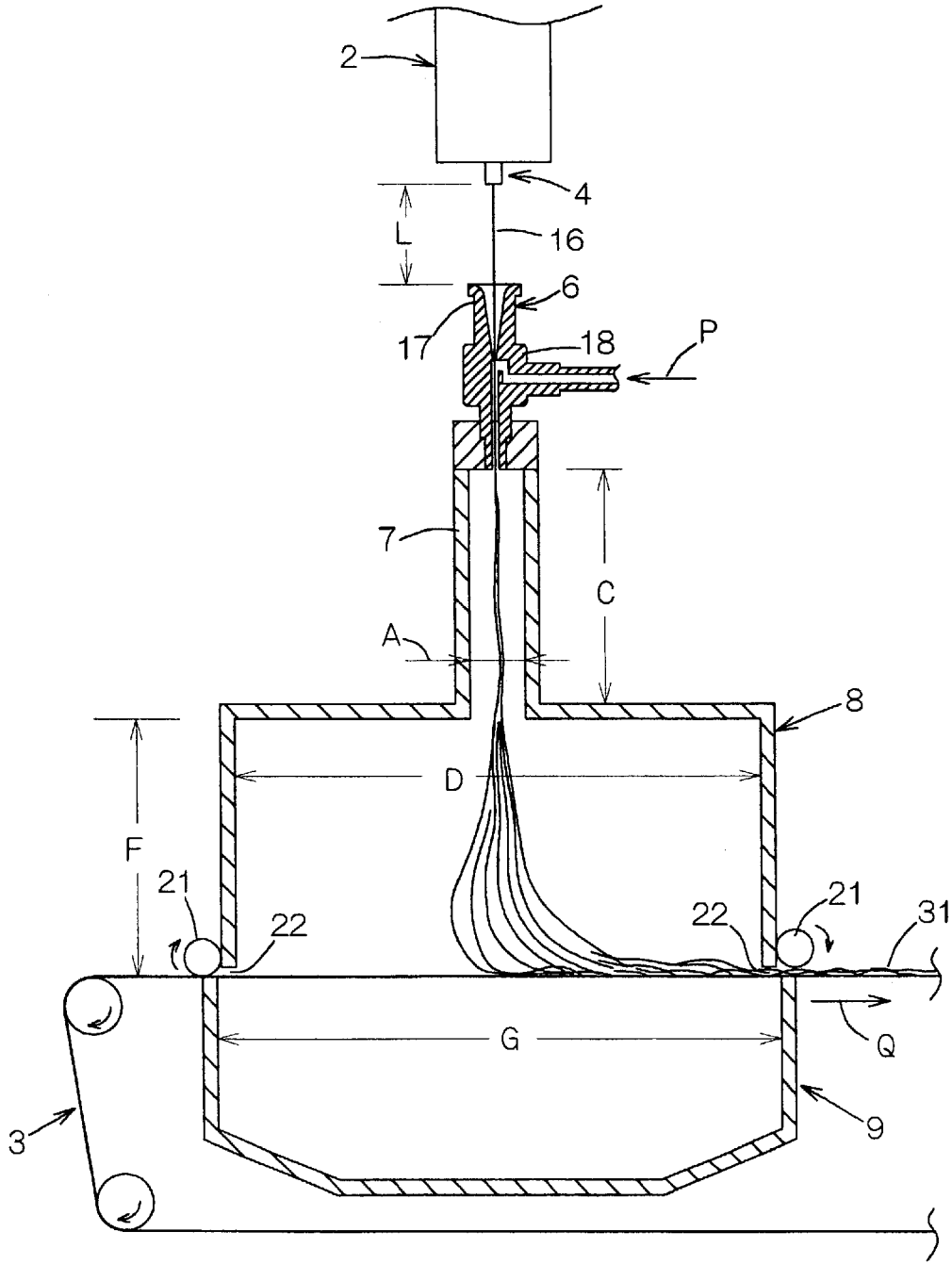
FIG. 2 is a sectional view taken along a line II—II in FIG. 1.

FIG. 1 is a fragmentary perspective view showing an apparatus for making a nonwoven fabric 1 and FIG. 2 is a sectional view taken along a line II—II in FIG. 1. The apparatus 1 includes an extruder 2 and an array comprising a plurality of spinning nozzles 4 arranged transversely of an endless belt 3 running in a direction indicated by an arrow Q. Between the array of nozzles 4 and the endless belt 3, an air gun 6, a duct 7 and a hood 8 are connected one to another in this order so as to establish a substantially air tight condition. A box 9 underlies the hood 8 with the endless belt 3 therebetween and an exhaust duct 11 extends from the box 9 in a direction indicated by an arrow X. The exhaust duct 11 has its distal end connected to a blower (not shown).

The array of nozzles 4 each having an orifice diameter of 0.3~0.7 mm are arranged on a nozzle plate 2*a* of the extruder 2, which nozzle plate 2*a* extends transversely of the endless belt 3 having a width of 250~3000 mm. The array comprises 200~25000 nozzles 4 over a length of 200~25000 mm. The air gun 6 is spaced from the array of nozzles 4 by a distance L of 100~1500 mm. The duct 7 has a dimension A of 5~20 mm as measured in a running direction of the endless belt 3, a dimension B of 200~2500 mm as measured transversely of the endless belt 3 and a dimension C of 50~1000 mm as measured vertically of FIG. 1. The hood 8 has a dimension D of 50~1500 mm as measured in the running direction of the endless belt, a dimension E of 200~2500 mm as measured transversely of the endless belt 3 and a dimension F of 50~2000 mm as measured vertically of FIG. 1, and extends above the top surface of the endless belt 3 with a clearance 22. The box 9 has a dimension G of 50~1500 mm as measured in the running direction of the endless belt 3, a dimension H of 200~2500 mm as measured transversely of the endless belt 3 and a vertical dimension as viewed in FIG. 1 which may be optionally selected. The duct 7 is located at the middle of the hood 8 as viewed in the running direction of the endless belt 3 and the hood 8 is positioned substantially in vertical alignment with the box 9. In front and behind the endless hood 8, there are provided rollers 21. The rollers 21 function to close the clearance between the endless belt 3 and the hood 8 so that a negative pressure within the hood 8 may be maintained sufficiently high even during running of the endless belt 3. These rollers 21 are adapted to move vertically of the endless belt 3 as the rollers 21 rotate in the running direction of the endless belt 3.

The nozzles 4 continuously discharge a plurality of thermoplastic synthetic resin fibers 16 downward as viewed in figures, which are then introduced into an upper end portion 17 of the air gun 6. In the vertically middle portion 18 of the air gun 6, a flow of pressurized air supplied in a direction indicated by an arrow P and blows against the fibers 16 which are thereby accelerated downward into the duct 7. The fibers 16 pass straight through the relatively narrow duct 7 into the relatively wide hood 8 in which the fibers 16 are correspondingly decelerated. The hood 8 is vertically opposed to the box 9 having an open top with the air-permeable endless belt 3 therebetween. The box 9 is in fluid communication with the blower so that the interior of the hood 8 is maintained at a desired level of negative pressure under a suction by the box 9. The hood 8 at the desired level of negative pressure functions to pull the fibers 16 within the duct 7 so that these fibers 16 may be directed to the hood 8. The fibers 16 which have passed straight through the relatively narrow duct 7 in parallel one to another oscillate longitudinally as well as transversely of the endless belt 3 as these fibers 16 enter the hood 8 which lies adjacent the top surface of the endless belt 3 and is enlarged in the running direction of the endless belt 3. As a result, the fibers 16 are intertwined and accumulated on the top surface of the endless belt 3. The fibers 16 accumulated on the endless belt 3 in this manner are conveyed through the clearance 22 between the endless belt 3 and the hood 8 and then between the endless belt 3 and roller 21 to be brought out from the hood 8 and to be taken up in a roll of nonwoven fabric 31. Assumed that the fibers 16 are in molten or softened state as the fibers 16 are accumulated on the endless belt 3, the fibers 16 can be bonded one to another at their contacting points. Furthermore, oscillation of the fibers 16 within the hood 8 enables them to be mechanically intertwined.

During the process for making the nonwoven fabric 31 in this manner, the fibers 16 are stretched at a high ratio in the course from the nozzles 4 to the hood 8, particularly during a period elapsing from a point at which the fibers 16 have been discharged from the nozzles 4 to a point at which the fibers 16 begin to be accelerated by the air gun 6 period starting from being discharged from the nozzles 4. Such stretching is achieved by cooperation of a pressure of air blown from the air gun 6 with a pulling force of the hood 8 sucking this air. The gun 6, the duct 7 and the hood 8 may be directly connected one to another and the clearance 22 defined between the hood 8 and the endless belt 3 may be closed by the respective rollers 21 to ensure the pulling force to act upon the fibers 16.

In order to ensure that the fibers 16 are stretched at a desired high ratio and, after having stretched, oscillate over a relatively large extent as measured longitudinally as well as transversely of the endless belt 3, A:C, a ratio of a dimension A of the duct 7 to a dimension C of the duct 7 is preferably in a range of 1:2.5~1:200, C:D, a ratio of the dimension C of the duct 7 to a dimension D of the hood 8 is preferably in a range of 1:1~1:1.5. F:D, a ratio of the dimension F of the hood to a dimension D of the hood 8 is preferably in a range of 1:1~1:1.3. A suction capacity of the box 9 is preferably in a range of 8~30 times the air discharge from the air gun 6.

Figure 3:
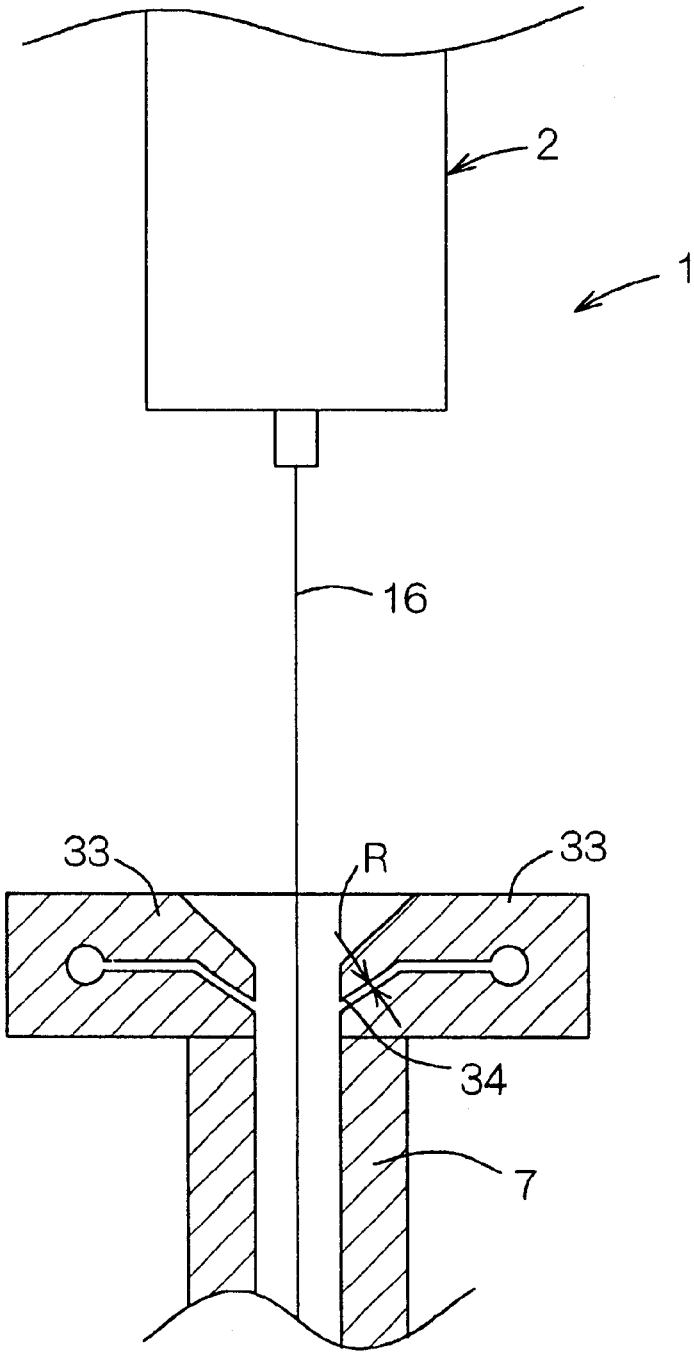
FIG. 3 is a fragmentary sectional view showing an alternative embodiment of the invention.

FIG. 3 is a fragmentary sectional view schematically showing a part of the apparatus similar to the embodiment of the invention shown in FIGS. 1 and 2. This apparatus 1 is similar to the apparatus shown in FIGS. 1 and 2 except that the air gun 6 is replaced by sucker 33 placed in a laterally symmetric relationship about the fibers 16 as the means to blow the pressurized air against the fibers 16. A clearance R of each blow nozzle 34 in each of the suckers 33 is adjusted in a range of 0.1~1.0 mm so that a stretching ratio of the fibers 16 may be controlled in this range.

EXAMPLE

Polypropylene having a melt flow rate of 70 as measured in accordance with the prescription of JIS K 7210 was extruded and stretched to obtain continuous fibers and a nonwoven fabric formed with these continuous fibers using the apparatus of FIG. 3. Table 1 shows a relationship between conditions under which the continuous fibers are made and fineness (d).

Control 1

Using polypropylene similarly to the EXAMPLE, the continuous fibers were obtained by the apparatus of FIG. 3 deprived of the hood and the nonwoven fabric was made from these continuous fibers. CONTROL 1 in Table 1 shows a relationship between conditions under which the continuous fibers are made and fineness.

Control 2

Using polypropylene similarly to the EXAMPLE, the continuous fibers were obtained by the apparatus of FIG. 3 deprived of the suckers and the nonwoven fabric was made from these continuous fibers. CONTROL 2 in Table 1 shows a relationship between conditions under which the continuous fibers are made and fineness.

Control 3

Using polypropylene similarly to the EXAMPLE, the continuous fibers were obtained by the apparatus of FIG. 3 in which the suckers were spaced apart from the duct by 30 mm and the nonwoven fabric was made from these continuous fibers. CONTROL 3 in Table 1 shows a relationship between conditions under which the continuous fibers are made and fineness.

Control 4

Using polypropylene similarly to the EXAMPLE, the continuous fibers were obtained by the apparatus of FIG. 3 in which a suckers air flow was adjusted to be 4.8 times a suction air flow and the nonwoven fabric was made from these continuous fibers. CONTROL 4 in Table 1 shows a relationship between conditions under which the continuous fibers are made and fineness.

TABLE 1

| | EXAMPLE | CONTROL 1 | CONTROL 2 | CONTROL 3 | CONTROL 4 |
|---|---|---|---|---|---|
| Resin | Polypropylene | Polypropylene | Polypropylene | Polypropylene | Polypropylene |
| Nozzle Discharge (g/min/hole) | 1.0 | 1.0 | 1.0 | 1.0 | 1.0 |
| Nozzle ~ Sucker | 1000 | 1000 | — | 1000 | 1000 |
| Distance (mm) | — | — | 1000 | — | — |
| Sucker Clearance (mm) | 0.15 | 0.15 | — | 0.15 | 0.15 |
| Sucker ~ Duct Distance (mm) | 0 | 0 | — | 30 | 0 |
| Duct Dimensions: A (mm) | 7.0 | 7.0 | 7.0 | 7.0 | 7.0 |
| C | 300 | 300 | 300 | 300 | 300 |
| Hood Dimensions: D | 500 | — | 500 | 500 | 500 |
| F | 600 | — | 600 | 600 | 600 |
| Sucker Air Flow ($Nm^3$/min/m) | 9.3 | 9.3 | — | 9.3 | 9.3 |
| Suction Air Flow | 133.3 | 133.3 | 133.3 | 133.3 | 45 |

TABLE 1-continued

| | EXAMPLE | CONTROL 1 | CONTROL 2 | CONTROL 3 | CONTROL 4 |
|---|---|---|---|---|---|
| ($Nm^3$/min/m) | | | | | |
| Suction Air Flow to Sucker Air Flow (times) | 14.3 | 14.3 | — | 14.3 | 4.8 |
| Fineness (d) | 0.97 | 1.59 | 1.89 | 1.19 | 1.60 |

As will be apparent from comparison of these examples with controls 1~4, the apparatus 1 according to this invention is able to obtain the continuous fibers having a fineness of 1 d or less and to make desired nonwoven fabric from these continuous fibers.

The apparatus for making a nonwoven fabric according to this invention enables nonwoven fabric to be easily made from continuous fibers having a fineness of 1 d or less.

What is claimed is:

1. An apparatus for making nonwoven fabric, said apparatus having a passage having an open upper end for receiving continuous fibers discharged from a plurality of nozzles and an open lower end for discharging the continuous fibers onto a top surface of a movable air-permeable endless belt, said apparatus comprising, along said passage, an air inlet positioned downstream of said open upper end for directing pressurized air onto the continuous fibers;

a hood positioned downstream of said air inlet and having an upper end and a lower end that defines the open lower end of said passage; and a duct positioned between said air inlet and said hood and having a lower end directly connected to the upper end of said hood, wherein a cross-sectional dimension of the upper end of said hood, as measured in a running direction of the endless belt, is at least 2.5 times larger than that of the lower end of said duct.

2. The apparatus of claim 1, wherein the upper end of said hood is contiguous to the lower end of said duct.

3. The apparatus of claim 1, wherein said hood includes a transverse wall extending from and perpendicular to a circumferential wall of said duct; and side walls extending perpendicular to said transverse wall in a direction away from said duct.

4. The apparatus of claim 2, wherein said duct has a section including the lower end of said duct, and a cross-sectional dimension of said section, as measured in the running direction of the endless belt, is substantially constant throughout an entire longitudinal extent of said section along said passage and equal to the cross-sectional dimension of the lower end of said duct.

5. The apparatus of claim 4, wherein a ratio of the cross-sectional dimension of the lower end of said duct to the entire longitudinal extent of said section is in a range of 1:2.5~1:200.

6. The apparatus of claim 4, wherein a ratio of the entire longitudinal extent of said section to the cross-sectional dimension of the upper end of said hood is in a range of 1:1~1:1.5.

7. The apparatus of claim 3, wherein a cross-sectional dimension of said hood, as measured in the running direction of the endless belt, is substantially constant throughout an entire longitudinal extent of said hood along said passage and equal to the cross-sectional dimension of the upper end of said hood, and a ratio of the entire longitudinal extent of said hood to the cross-sectional dimension of the upper end of said hood is in a range of 1:1~1:1.3.

8. An apparatus for making nonwoven fabric, said apparatus being adapted to accumulate continuous fibers discharged from a plurality of nozzles onto a top surface of an air-permeable endless belt running in one direction under suction effect exerted from below said endless belt, wherein said apparatus, between said nozzles and said endless belt, comprises:

means for blowing pressurized air against said continuous fibers;

a duct directly connected to and extending downwardly from said means; and a hood directly connected to said duct and covering a vicinity of the top surface of said endless belt so that an interior of said hood is subjected to said suction effect exerted through said endless belt from below said endless belt;

wherein a ratio of a dimension of said duct as measured in said running direction to a vertical dimension of said duct as measured in a vertical direction from said nozzles toward said endless belt is in a range of 1:2.5~1:200;

a ratio of said vertical dimension of said duct to a dimension of said hood as measured in said running direction is in a range of 1:1~1:1.5; and said hood includes:

a transverse wall extending from and perpendicular to a circumferential wall of said duct; and side walls extending perpendicular to said transverse wall in a direction away from said duct.

9. An apparatus for making nonwoven fabric, said apparatus being adapted to accumulate continuous fibers discharged from a plurality of nozzles onto a top surface of an air-permeable endless belt running in one direction under suction effect exerted from below said endless belt, wherein said apparatus, between said nozzles and said endless belt, comprises:

means for blowing pressurized air against said continuous fibers;

a duct directly connected to and extending downwardly from said means; and a hood directly connected to said duct and covering a vicinity of the top surface of said endless belt so that an interior of said hood is subjected to said suction effect exerted through said endless belt from below said endless belt;

wherein a ratio of a dimension of said duct as measured in said running direction to a vertical dimension of said duct as measured in a vertical direction from said nozzles toward said endless belt is in a range of 1:2.5~1:200;

a ratio of said vertical dimension of said duct to a dimension of said hood as measured in said running direction is in a range of 1:1~1:1.5; and the dimension of said duct, that is measured in the running direction of the endless belt, is constant over a vertical extent of said vertical dimension of said duct.

10. An apparatus for making nonwoven fabric, said apparatus being adapted to accumulate continuous fibers discharged from a plurality of nozzles onto a top surface of an air-permeable endless belt running in one direction under suction effect exerted from below said endless belt, wherein said apparatus, between said nozzles and said endless belt, comprises:

means for blowing pressurized air against said continuous fibers;

a duct directly connected to and extending downwardly from said means; and a hood directly connected to said duct and covering a vicinity of the top surface of said endless belt so that an interior of said hood is subjected to said suction effect exerted through said endless belt from below said endless belt;

wherein a ratio of a dimension of said duct as measured in said running direction to a vertical dimension of said duct as measured in a vertical direction from said nozzles toward said endless belt is in a range of 1:2.5~1:200;

a ratio of said vertical dimension of said duct to a dimension of said hood as measured in said running direction is in a range of 1:1~1:1.5;

a ratio of a vertical dimension of said hood as measured in the vertical direction to the dimension of said hood as measured in said running direction is in a range of 1:1~1:1.3; and the dimension of said hood, that is measured in the running direction of the endless belt, is constant over an entire vertical extent of said hood.

* * * * *